US007419062B2

(12) United States Patent
Mason

(10) Patent No.: US 7,419,062 B2
(45) **Date of Patent: *Sep. 2, 2008**

(54) SHELF UNIT

(75) Inventor: Timothy L. Mason, Melville, NY (US)

(73) Assignee: New Dimensions Research Corporation, Melville, NY (US)

( * ) Notice: Subject to any disclaimer, the term of this patent is extended or adjusted under 35 U.S.C. 154(b) by 274 days.

This patent is subject to a terminal disclaimer.

(21) Appl. No.: 11/334,282

(22) Filed: Jan. 18, 2006

(65) Prior Publication Data

US 2007/0080123 A1 Apr. 12, 2007

Related U.S. Application Data

(63) Continuation-in-part of application No. 29/241,484, filed on Oct. 27, 2005.

(60) Provisional application No. 60/725,849, filed on Oct. 12, 2005.

(51) Int. Cl.
*A47F 1/04* (2006.01)

(52) U.S. Cl. ..... 211/59.3

(58) Field of Classification Search ..... 211/59.2, 211/59.3, 184, 74, 51, 126.1; 312/61, 71, 312/9.1, 185; D6/407, 475, 408, 449, 466, D6/476, 629, 630, 511; 206/307, 307.1, 206/310, 308.1

See application file for complete search history.

(56) References Cited

U.S. PATENT DOCUMENTS

| | | | | |
|---|---|---|---|---|
| 4,690,287 | A | 9/1987 | Fershko et al. | |
| 4,730,741 | A | 3/1988 | Jackle, III et al. | |
| D295,813 | S | 5/1988 | Rowse et al. | |
| 4,762,236 | A | 8/1988 | Jackle et al. | |
| 5,024,336 | A | 6/1991 | Spamer | |
| D322,989 | S | 1/1992 | Wood | |
| 5,265,738 | A * | 11/1993 | Yablans et al. | 211/59.3 |
| 5,706,956 | A * | 1/1998 | Headrick et al. | 211/59.2 |
| 5,855,283 | A * | 1/1999 | Johnson | 211/59.3 |
| 5,865,326 | A * | 2/1999 | Spamer et al. | 211/181.1 |

(Continued)

FOREIGN PATENT DOCUMENTS

| | | |
|---|---|---|
| EP | 0 914 788 | 5/1999 |

OTHER PUBLICATIONS

European Search Report including Preliminary Search Opinion.

*Primary Examiner*—Jennifer E. Novosad
(74) *Attorney, Agent, or Firm*—Collard & Roe, P.C.

(57) ABSTRACT

A shelf unit for displaying products in a space saving manner includes brackets for securing to a support and a tray extending between the brackets. The tray has a front portion with edges arranged so that adjacent edges are disposed at alternating angles to form a sawtooth pattern. A face portion configured to conform to the front portion is disposed over the front portion and has a window for viewing a product disposed behind the window. Adjustable partitions are disposed on the tray and define rows for displaying the products. A biasing mechanism biases the products in the row toward a front of the shelf unit. Each biasing mechanisms has a biasing element and a slidable product advancing member. The products are arranged in adjacent rows at alternating angles to form a sawtooth pattern corresponding to the edges of the front portion of the tray.

11 Claims, 4 Drawing Sheets

U.S. PATENT DOCUMENTS

| | | | | |
|---|---|---|---|---|
| 5,918,954 | A * | 7/1999 | Papadakis et al. | 312/126 |
| D422,436 | S | 4/2000 | Fisher | |
| 6,142,316 | A * | 11/2000 | Harbour et al. | 211/59.2 |
| 6,237,784 | B1 * | 5/2001 | Primiano | 211/59.2 |
| 6,523,702 | B1 * | 2/2003 | Primiano et al. | 211/59.2 |
| D474,923 | S | 5/2003 | Johnson | |
| D489,556 | S | 5/2004 | Mason | |
| 6,866,155 | B2 * | 3/2005 | Nagel | 211/59.3 |
| D509,982 | S | 9/2005 | Yang | |
| D515,346 | S | 2/2006 | Yang | |
| 7,032,761 | B2 * | 4/2006 | Nagel | 211/59.3 |
| 7,140,499 | B2 * | 11/2006 | Burke | 211/59.3 |
| 7,182,209 | B2 * | 2/2007 | Squitieri | 211/59.2 |
| 2001/0020604 | A1 * | 9/2001 | Battaglia et al. | 211/59.2 |
| 2004/0020877 | A1 * | 2/2004 | Boron | 211/59.2 |
| 2005/0199564 | A1 * | 9/2005 | Johnson et al. | 211/59.3 |

* cited by examiner

SHELF UNIT

CROSS REFERENCE TO RELATED APPLICATIONS

This application claims the benefit of U.S. Provisional Application No. 60/725,849 filed on Oct. 12, 2005. This application is a continuation-in-part of application Ser. No. 29/241,484 filed on Oct. 27, 2005.

BACKGROUND OF THE INVENTION

1. Field of the Invention

The invention relates to shelf units and more particularly to shelf units having trays designed to hold modular merchandise units in a sawtooth or zig-zag arrangement so as to present the face of the product to a potential customer more effectively and efficiently.

2. The Prior Art

Merchandise for retail sale is typically arranged in parallel rows on modular shelving units. Such an arrangement allows prospective purchasers to view and select a product for purchase. As merchandise is removed from a front of the display, the shelf is re-stocked and leveled by moving merchandise to a front of the shelf to present a neat, orderly and fully stocked appearance.

In shelving arrangements according to the prior art, product units are generally disposed in parallel rows with a face of each product arranged substantially parallel to a straight front edge of the shelf. In such an arrangement, the number of rows of products which can be disposed on a shelf is limited by the width of the products. This layout fails to make efficient use of the available shelf space. In addition, an entire row of products stocked on a conventional shelf unit may be easily accessible to shoplifters.

Accordingly, there exists a need for a shelf unit wherein product units are arranged in a space-saving manner to make more efficient use of available shelf space. Moreover, a need exists for a shelf unit wherein access to a portion of the products disposed on the shelf unit is limited so as to eliminate or reduce the occurrence of pilferage.

SUMMARY OF THE INVENTION

The invention relates to shelf units and more particularly to shelf units having trays designed to hold modular merchandise units such as packet boxes filled with merchandise such as razor blades in a sawtooth or zig-zag arrangement so as to present the face of the product to a potential customer more effectively and efficiently.

In one embodiment of the invention, a shelf unit for displaying a plurality of products in a space saving manner includes a plurality of brackets for securing the shelf unit to a support. A tray extends between the brackets. The tray has a front portion with a plurality of edges arranged with adjacent edges disposed at alternating angles to form a sawtooth pattern. A face portion is disposed over the front portion of the tray and is configured to conform substantially to the front portion. The face portion has one or more windows for viewing a product disposed behind the window.

Adjustable partitions are disposed on the tray and arranged substantially parallel to the brackets to define a plurality of rows for displaying the products. A biasing mechanism is disposed in a respective row of the plurality of rows for biasing the products in the row toward a front of the shelf unit. Each biasing mechanism may comprise a biasing element and a slidable product advancing member.

When products are arranged in adjacent rows on the shelf unit according to an embodiment of the invention, the products are arranged at alternating angles to form a sawtooth pattern corresponding to the plurality of edges of the front portion of the tray.

One advantage of a shelf unit according to an embodiment of the invention is that products may be arranged in adjacent rows and at alternating angles to form a sawtooth or zig zag pattern, thereby permitting a greater number of products to be displayed for a given amount of shelf space.

A further advantage of a shelf unit according to an embodiment of the invention is that a biasing mechanism may be provided to bias the product in a row toward a front of the shelf unit, thereby eliminating the need for manual leveling of the rows of displayed products.

Another advantage of a shelf unit according to an embodiment of the invention is that individual rows for displaying products may be defined by adjustable partitions, wherein a width of a row may be adjusted to accommodate the dimensions of a particular product to be displayed.

Another advantage of a shelf unit according to an embodiment of the invention is that a face portion may be provided which includes windows allowing prospective purchasers to view the various products displayed on the shelf unit. The window may further include an aperture or finger hole may to facilitate loading of products in the row. The face portion may be stationary or may be secured to the shelf unit with one or more hinges, wherein the face portion may be adapted to pivot or swing open for loading the products and to pivot or swing closed after the products have been stocked. A locking mechanism may lock the face portion in an open or closed position.

Another advantage of a shelf unit according to an embodiment of the invention is that an upwardly-biased paddle or stop may be provided in a row to facilitate loading of products in the row.

A further advantage of a shelf unit according to an embodiment of the invention is that a wire grid may be disposed at a top portion of the shelf unit to prevent or minimize losses due to shoplifting by restricting access to products disposed on the shelf unit.

BRIEF DESCRIPTION OF THE DRAWINGS

Other benefits and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE DRAWINGS

Figure 1:
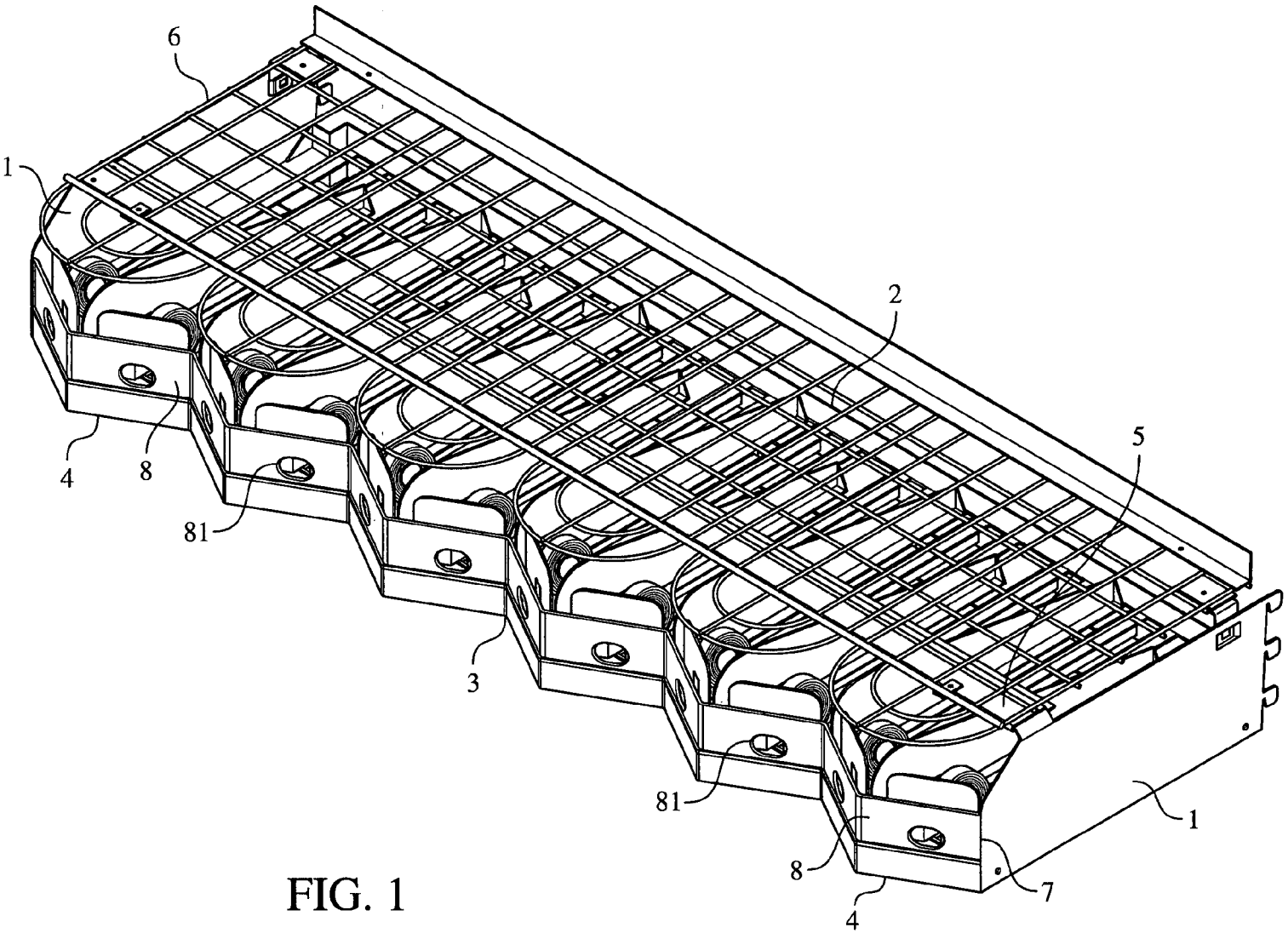
FIG. 1 shows a perspective view of a shelf unit according to an embodiment of the invention.

Referring now in detail to the drawings and, in particular, FIG. 1 shows a perspective view of a shelf unit according to an embodiment of the invention. The shelf unit may include a plurality of brackets 1 for securing the shelf unit to a support (not shown). Bracket 1 may comprise, for example, a knife bracket formed from a steel stamping and powder coated. As shown, bracket 1 may include one or more projections disposed at a rear portion thereof for securing the bracket to a modular support. The bracket projections may be inserted into corresponding apertures provided in a modular support to locate and secure the shelf unit at an appropriate height. Multiple shelf units according to an embodiment of the invention may be secured to a support and positioned one over another in a stacked manner.

A tray 2 extends between the brackets 1. Tray 2 may be formed from any suitable rigid material, for example injection molded acrylonitrile butadiene styrene (ABS) plastic. As shown, tray 2 includes a front portion 3 comprising a plurality of edges 4. Plurality of edges 4 are arranged with adjacent edges 4 disposed at alternating angles to form a sawtooth or zig zag pattern.

A cross-bar 5 may be secured to brackets 1 and disposed over tray 2. Cross-bar 5 may strengthen and provide added rigidity to the shelf unit. Moreover, cross-bar 5 may provide support for a wire grid 6 disposed over tray 2. Wire grid 6 may be secured to brackets 1 and cross-bar 5 as shown. Wire grid 6 may extend from a rear portion of tray 2 to an area just behind front portion 3 of tray 2, thereby covering most of the product units disposed on the shelf unit and leaving only the front-most product or products accessible. In this way, wire grid 6 may serve as a security mechanism by preventing a prospective shoplifter from reaching into the shelf unit from above and removing an entire row or rows of products from the shelf unit.

In an embodiment of the invention, a plurality of shelf units may be secured to a support and stacked one on top of another, leaving only a small vertical spacing between units. An uppermost shelf unit may include wire grid 6 for restricting access to the products disposed on the uppermost shelf unit. The cross-bar 5 disposed over the trays 2 may further provide a security function by preventing the removal of a shelf unit from the support without first removing the unit positioned immediately over the shelf unit sought to be removed. In this way, a prospective shoplifter is unable to remove an entire shelf unit and gain access to the products disposed therein without first removing each shelf unit located over the unit. This feature further restricts access to the products disposed on a shelf unit according to an embodiment of the invention and prevents or reduces the occurrence of theft.

A face portion 7 is disposed over the front portion 3 of the shelf unit. Face portion 7 is configured to conform substantially to the shape of front portion 3 and follows the sawtooth or zig zag pattern formed by edges 4 of tray 2. Face portion 7 may comprise one or more windows 8 arranged so that products disposed on the shelf unit behind the windows 8 may be viewed. Windows 8 may be formed from a transparent or semi-transparent material, for example injection molded clear polycarbonate plastic.

A shelf unit according to an embodiment of the invention further comprises a plurality of adjustable partitions or dividers 9 disposed on tray 2. Partitions or dividers 9 are arranged substantially parallel to brackets 1 and form a plurality of rows defined on one side by partition 9 and on another side by an second partition 9 or bracket 1. Partitions 9 are adjustable so that a width of each individual row may be adjusted to accommodate the dimensions of the product to be housed in the particular row. Adjustable partitions may be configured so that they are free to slide left or right as products are loaded into a row. Such partitions are self-adjusting in that the product find its proper row width by displacing the flexible partition or partitions. In an additional embodiment, partitions 9 may be locked into a plurality of fixed positions, forming rows of appropriate widths. For example, partitions 9 may snap into place on tray 2. Fixed stops or snaps for locating the partition 9 may be spaced at ½ inch or ¼ inch intervals, thereby allowing for precise positioning of the partition. When a partition is snapped or otherwise secured in place in this embodiment, products in an adjacent row will not encroach or displace the partition.

Figure 2:
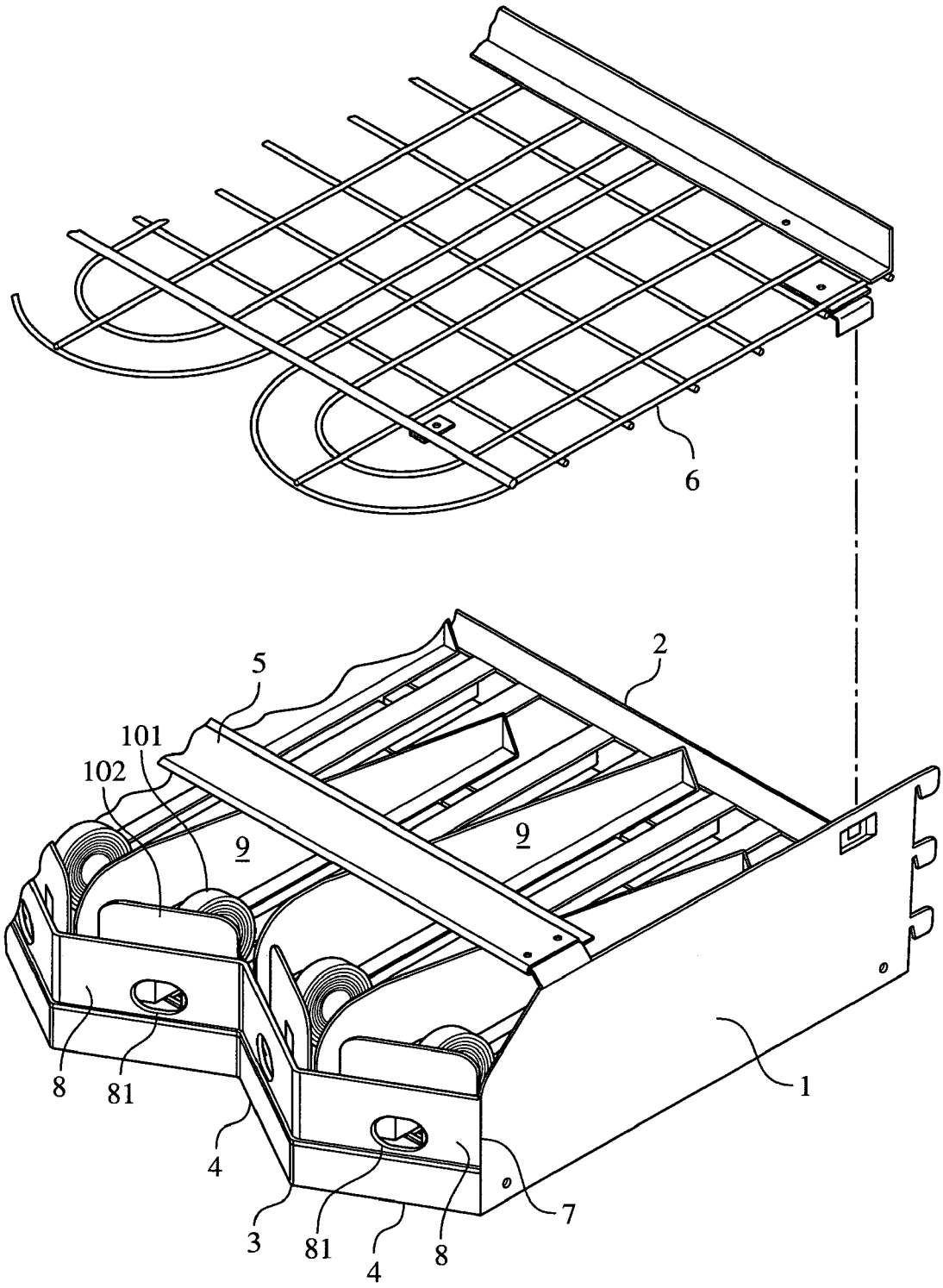
FIG. 2 shows a close up view of a portion of the shelf unit shown in FIG. 1.
Figure 4:
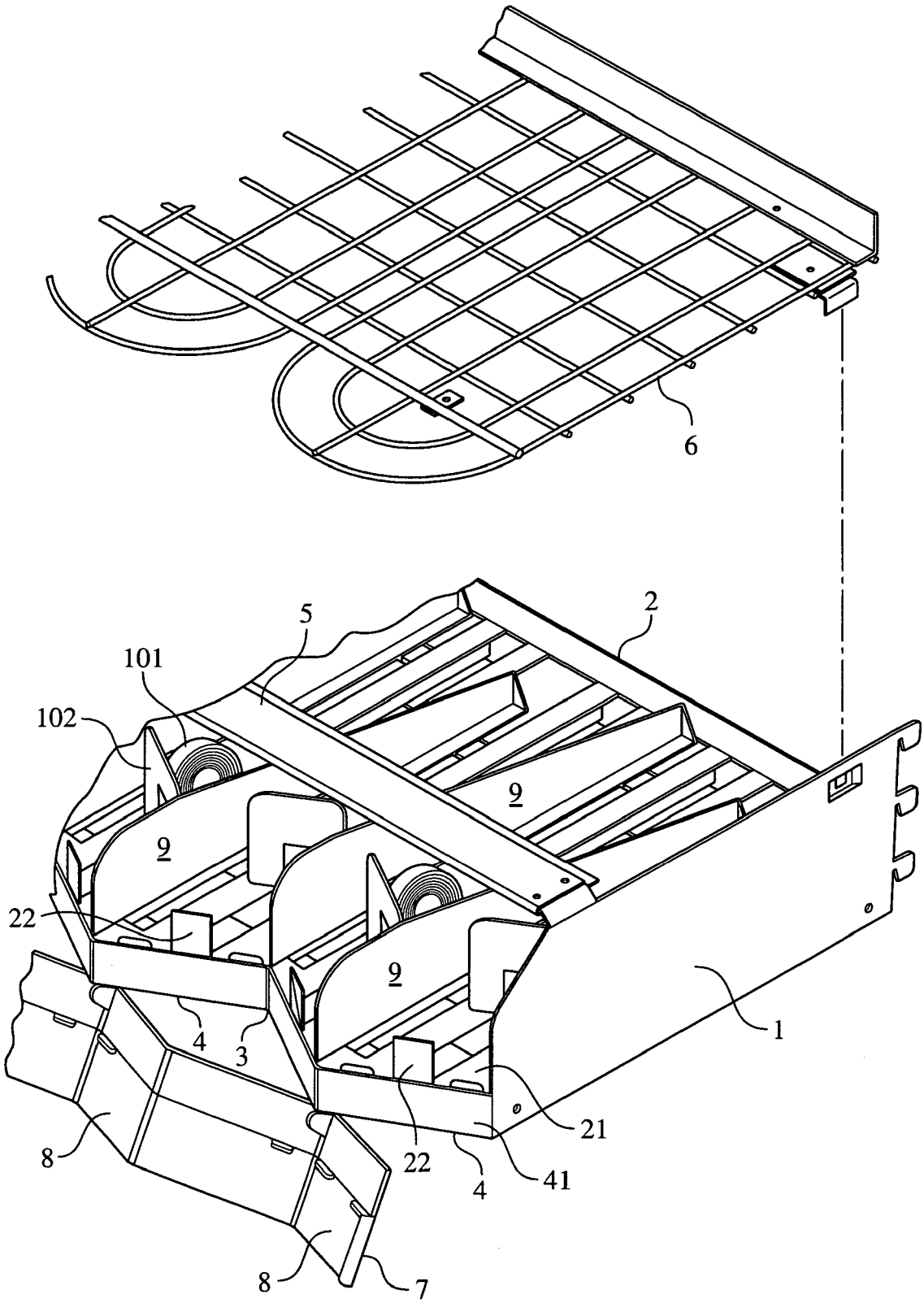
FIG. 4 shows a close up view of a portion of the shelf unit shown in FIG. 3.

Each row in the shelf unit according to an embodiment of the invention may further include a biasing mechanism or pusher for biasing the product in that row toward the front of the shelf unit, where the product can be viewed and accessed by purchasers. As shown in FIGS. 2 and 4, the biasing mechanism includes a biasing element 101 and a slidable product advancing member 102. Slidable product advancing member may have a face disposed substantially parallel to the edge 4 at the front of the row wherein the biasing mechanism is disposed, as shown.

Biasing element 101 may comprise a spring element which is secured at one end near a front of the row. In the embodiments shown, biasing element 101 comprises a length of flat metal spring material which is secured at one end near a front of the row and forms a coil which is uncoiled as slidable product advancing member 102 is moved toward a rear of the row. The coiled spring biases the product advancing member 102 toward a front of the shelf unit. Thus, as products are removed from the front of a row of products, the biasing mechanism displaces the remaining row of product toward a front of the shelf unit, thereby maintaining a neat, fully stocked appearance and eliminating the need for manual leveling.

Products may be arranged in the adjacent rows defined by a pair of partitions 9 or a partition 9 and a bracket 1 at alternating angles to form a sawtooth pattern corresponding to the pattern formed by the plurality of edges 4 at the front portion of tray 2. Each row of products forms a non-right angle with respect to bracket 1 with adjacent rows of products angled out from a rear of the shelf unit and in toward a rear of the shelf unit in an alternating manner to form a sawtooth or zig zag pattern.

By arranging the products in rows with adjacent rows disposed at alternating angles, it is possible to fit more products in a given amount of shelf space as compared to conventional arrangements wherein products are arranged in parallel rows at substantially right angles to a shelf bracket. The arrangement of products in a shelf unit according to an embodiment of the invention achieves significant space saving, allowing more products to be stocked in a given amount of shelf space. For example, in the embodiment shown in the drawings, twelve rows of products are arranged on a shelf unit which takes up a linear space which would accommodate only ten rows of the same product if arranged in a conventional manner in parallel rows.

A shelf unit according to an embodiment of the invention may be sized and shaped so that it is suitable for holding a particular product or class of products. For example, the embodiment shown in the drawing figures may be used to display and hold packages of razor blade cartridges in a space-saving manner. The dimensions of the shelf unit can be adapted to accommodate a wide variety of products for retail sale, for example personal care products or any other products which are suitable for displaying on a conventional shelf assemblies.

Figure 3:
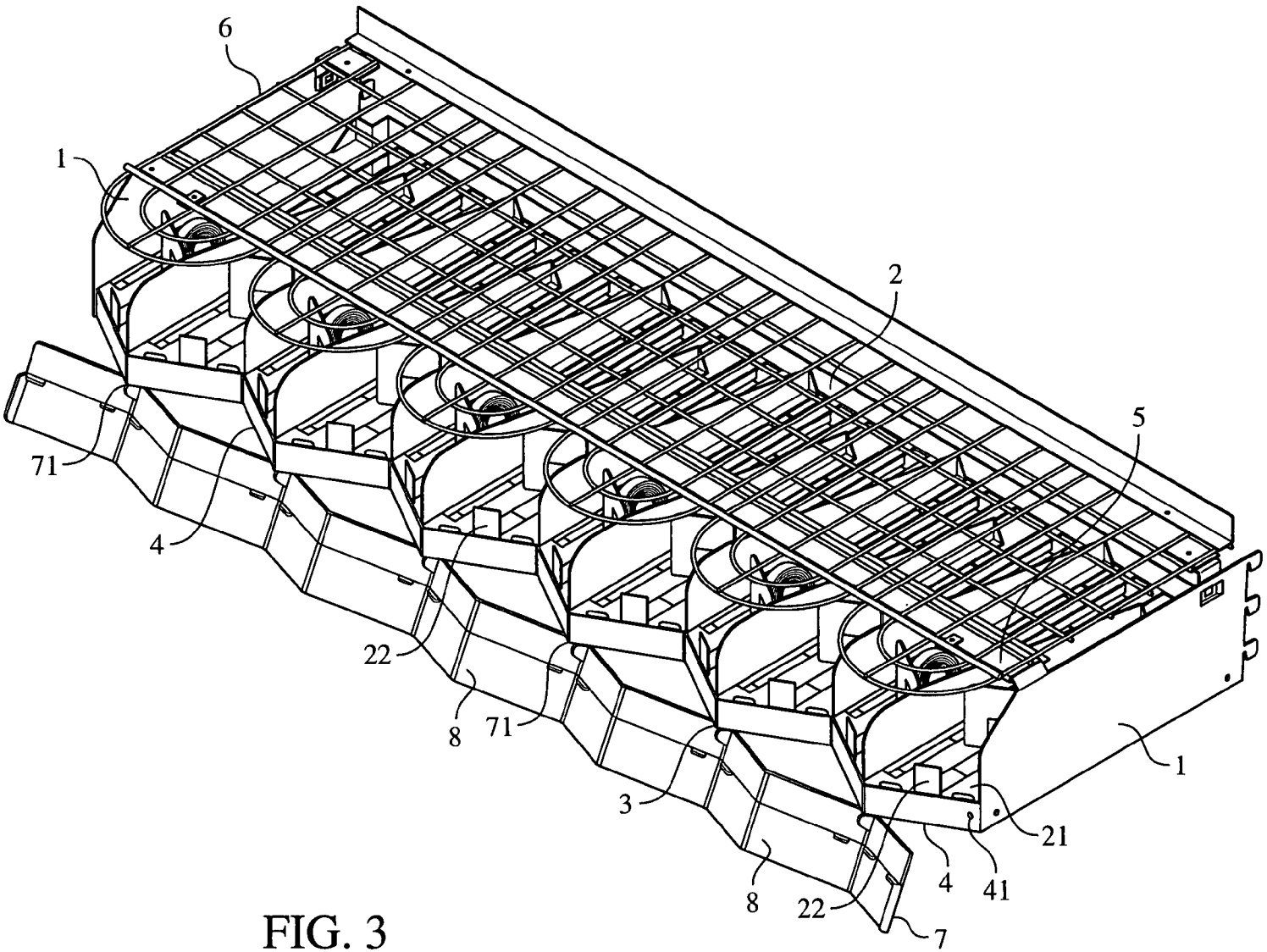
FIG. 3 shows a perspective view of a shelf unit according to another embodiment of the invention.

As shown in FIGS. 3 and 4, tray 2 may have a floor portion 21 disposed at a bottom of tray 2. The plurality of edges 4 arranged in a saw-tooth pattern may extend upwardly from floor portion 21 to form a plurality of walls 41. Walls 41 are generally parallel to edges 4 so that the plurality of walls 41 to form a sawtooth pattern.

Face portion 7 of the shelf unit may be secured to tray 2 in a stationary manner, as illustrated in FIGS. 1 and 2, or alternatively may be secured to tray 2 with one or more hinges 71, as illustrated in FIGS. 3 and 4. Hinges 71 allow face 7 to pivot between an open position (as shown in FIGS. 3 and 4) for loading products into the shelf unit and a closed position. A locking mechanism may be provided for locking the drop down face 7 in either an open or closed position. During loading, the drop down hinged face may be moved to the open position so that products may be inserted into appropriate rows of the shelf unit from the front. Following the stocking of the shelf, the face 7 is moved to the closed position. The locking mechanism may be adapted so that face 7 may be locked in place only by authorized persons, for example by a store employee.

As shown in FIGS. 3 and 4, a shelf unit according to an embodiment of the invention may include one or more paddles or stops 22 disposed in one or more of the product rows. Paddles 22 are pivotally mounted to tray 2 and are adapted to pivot downwardly toward a rear of the shelf unit as products are loaded into the respective row. Paddles 22 are biased in a upward position, for example with a spring mechanism, so that paddles 22 return to a vertical position when no longer held down by a product.

Paddles 22 assist in front loading of the shelf unit by allowing a plurality of products to be loaded at one time, rather than loading just a single unit at a time. As products are placed into a particular row, the paddle 22 pivot down toward a rear of the shelf unit and the products push against the biasing mechanism or pusher, displacing it toward the rear of the shelf unit. Once the row of products is pushed past the paddle 22, the paddle 22 flips up into its vertical state and acts as a stop, preventing the biasing mechanism from pushing the row of products all the way to the front of the shelf unit. This feature facilitates the loading of a plurality of product units into the shelf unit, and allows for more efficient stocking of the shelf unit.

As shown in FIGS. 1 and 2, a shelf unit according to an embodiment of the invention may include one or more apertures 81 to facilitate loading of products into the shelf unit. Apertures 81 are disposed in window portion 8 of face 7. Apertures 81 comprise a through hole or finger hole sized so that a person responsible for stocking the shelf unit may insert one or more of their fingers through aperture 81 to push a row of products in the respective row back toward a rear of the shelf unit against the biasing mechanism. For example, in the embodiment shown in FIGS. 1 and 2, product units may be loaded into the rows of the shelf unit from above and a person may push the products already disposed in a row back against the biasing mechanism by inserting one or more of their fingers through aperture 81, thereby making room to insert one or more additional products from above.

Accordingly, while several embodiments of the present invention have been shown and described, it is obvious that many changes and modifications may be made thereunto without departing from the spirit and scope of the invention.

What is claimed is:

1. A shelf unit for displaying a plurality of products in a space saving manner, the shelf unit comprising:

a) plurality of brackets for securing the shelf unit to a support;

b) a tray extending between said plurality of brackets, said tray comprising a front portion comprising a plurality of edges arranged with adjacent edges disposed at alternating angles to form a sawtooth pattern;

c) a face portion disposed over said front portion and configured to conform substantially to said front portion, said face portion comprising a window for viewing a product disposed behind said window;

d) a plurality of adjustable partitions disposed on said tray arranged substantially parallel to said plurality of brackets to define a plurality of rows for displaying the plurality of products; and e) a plurality of biasing mechanisms, each biasing mechanism disposed in a respective row of said plurality of rows for biasing the products in the row toward a front of the shelf unit, each of said biasing mechanisms comprising a biasing element and a slidable product advancing member;

wherein when products are arranged in adjacent rows, the products are arranged at alternating angles to form a sawtooth pattern corresponding to the plurality of edges of said front portion of said tray.

2. The shelf unit according to claim 1, further comprising a cross-bar secured to said plurality of brackets and disposed over said tray.

3. The shelf unit according to claim 1, wherein said tray further comprises a floor portion and said plurality of edges extend upwardly from said floor portion to form a plurality of walls arranged with adjacent walls disposed at alternating angles to form a sawtooth pattern.

4. The shelf unit according to claim 1, wherein said slidable product advancing member further comprises a face disposed substantially parallel to an edge from said plurality of edges, said edge disposed at a front of the respective row wherein the biasing mechanism is disposed.

5. The shelf unit according to claim 1, wherein said face portion is secured to said front portion of said tray with a hinge for pivoting between an open position for loading and a closed position.

6. The shelf unit according to claim 5, further comprising a locking mechanism for locking said face portion in said open position.

7. The shelf unit according to claim 5, further comprising a locking mechanism for locking said face portion in said closed position.

8. The shelf unit according to claim 1, further comprising a plurality of paddles, each paddle disposed in a respective row of said plurality of rows, wherein each of said paddles is pivotally mounted to said tray for pivoting downwardly when the product is loaded into the respective row and wherein each of said paddles is upwardly biased for pivoting upwardly when the product is pushed past said paddle.

9. The shelf unit according to claim 1, wherein said window has an aperture to facilitate loading of the products.

10. The shelf unit according to claim 1, further comprising a wire grid disposed over said tray.

11. A shelf unit for displaying a plurality of products in a space saving manner, the shelf unit comprising:

a) plurality of brackets for securing the shelf unit to a support;

b) a tray extending between said plurality of brackets, said tray comprising a front portion comprising a plurality of edges arranged with adjacent edges disposed at alternating angles to form a sawtooth pattern;

c) a cross-bar secured to said plurality of brackets and disposed over said tray;

d) a face portion disposed over said front portion and configured to conform substantially to said front portion, said face portion comprising a window for viewing a product disposed behind said window, wherein said window has an aperture to facilitate loading of the products;

e) a plurality of adjustable partitions disposed on said tray arranged substantially parallel to said plurality of brackets to define a plurality of rows for displaying the plurality of products; and f) a plurality of biasing mechanisms, each biasing mechanism disposed in a respective row of said plurality of rows for biasing the products in the row toward a front of the shelf unit, each of said biasing mechanisms comprising a biasing element and a slidable product advancing member, said slidable product advancing member comprising a face disposed substantially parallel to an edge disposed at a front of the respective row wherein the biasing mechanism is disposed;

wherein when products are arranged in adjacent rows, the products are arranged at alternating angles to form a sawtooth pattern corresponding to the plurality of edges of said front portion of said tray.

* * * * *